US005125542A

United States Patent [19]

Blanc

[11] Patent Number: 5,125,542

[45] Date of Patent: Jun. 30, 1992

[54] PACKAGING FOR COFFE BEANS SECURABLE DIRECTLY ON A COFFEE MILL AND COMPRISING A CONNECTING DISPENSING CAP

[75] Inventor: Jean P. Blanc, Gattieres, France

[73] Assignee: Compagnie Mediterraneenne des Cafes S.A., Carros, France

[21] Appl. No.: 543,580

[22] Filed: Jun. 26, 1990

[30] Foreign Application Priority Data

Jul. 18, 1989 [FR] France ..... 89 09753

[51] Int. Cl.[5] ..... B67D 5/06

[52] U.S. Cl. ..... 222/181; 222/529; 222/561

[58] Field of Search ..... 222/181, 185, 526, 527, 222/529, 530, 537, 538, 540, 545, 561

[56] References Cited

U.S. PATENT DOCUMENTS

| | | | |
|---|---|---|---|
| 410,463 | 9/1889 | Stopple et al. | 222/181 |
| 2,244,071 | 6/1941 | Landrus | 222/561 |
| 2,315,473 | 3/1943 | Wolcott | 222/185 |
| 2,416,811 | 3/1947 | Bailey | 222/561 |
| 2,609,122 | 10/1951 | Stevenson | 222/105 |
| 2,781,955 | 2/1957 | Kidd | 222/561 |
| 2,895,654 | 7/1959 | Rieke | 222/530 |
| 3,368,722 | 2/1968 | Wallace | 222/561 |
| 4,236,629 | 12/1980 | Dwinell | 222/530 |
| 4,568,006 | 2/1986 | Mueller et al. | 222/530 |
| 4,765,499 | 8/1988 | Von Reis et al. | 220/321 |
| 4,856,681 | 8/1989 | Murray | 222/561 |

FOREIGN PATENT DOCUMENTS

| | | | |
|---|---|---|---|
| 0024310 | 3/1981 | European Pat. Off. . | |
| 0221419 | 6/1988 | European Pat. Off. | 222/538 |
| 534776 | 3/1941 | United Kingdom | 222/181 |
| 688531 | 3/1953 | United Kingdom | 222/526 |
| 736834 | 9/1955 | United Kingdom | 222/185 |

*Primary Examiner*—Michael S. Huppert
*Assistant Examiner*—Kenneth Bomberg
*Attorney, Agent, or Firm*—Young & Thompson

[57] ABSTRACT

A package for granular material, particularly coffee beans, of the type of a metal can (1) with a withdrawable neck (2) of flexible plastic secured by a ring (3) clamped on the opening (4) of the can (1). The can comprises cone (5) at this level, and a protective snap-on cap (7) that snaps on to the metal part of the clamping ring (3) which protects the withdrawable neck (2), itself closed by a screw cap (8) and between the neck (2) and the threaded cap (8) there is an apertured ring (9) of a valve which serves as a cap release valve. The end of the withdrawable neck (2) is screw threaded and receives a device serving as a dispensing connecting closure (12) which comprises, at its first end, an adapter cone (13) followed by a screw-threaded cylindrical portion (14) which permits securement to a screw-threaded end (11) of the neck (2). The adapter cone (13) of the connector closure (12) is sufficiently large that the can (1) will be stable when supported by its cone (5) on the connector closure (12).

1 Claim, 4 Drawing Sheets

PACKAGING FOR COFFE BEANS SECURABLE DIRECTLY ON A COFFEE MILL AND COMPRISING A CONNECTING DISPENSING CAP

The invention has for its object packaging for coffee beans securable directly to the coffee mill and comprising a connecting dispensing cap.

Numerous packagings comprise special closures with pourers, dispensers, etc. These closures do not permit direct connection on the kitchen appliance.

The state of the art may be defined by the following patents:

FR-A.2.609.453

Apparatus for closing and dispensing with double security.

The invention relates to a closure and dispensing device permitting risk-free continuous flow of a powdered or particulate product (liquid in the case of a sealed dispenser).

It is constituted by a closure having on its upper surface a pouring spout and an undulant shape. It is partially pierced on its lateral surface to permit the slide member of the dispenser to have limited rotation. In the embodiment according to FIG. II, the closure comprises in its lower portion a flange and groove. The dispensing assembly is introduced into the closure.

It has at its center on its upper and lower surfaces an opening, two rods and a slide. A support also has two openings. This latter is replaced when the mouthpiece does not have a concave surface, by the support. The support comprises two openings and a flange.

The device according to the invention is particularly adapted for the field of conservation.

FR-A.2.466.756

Dispensing device for a fluid or pulverulent material and its use on a coffee mill.

The dispensing device of a pulverulent material comprises a dispensing receptacle adapted to be supplied with a predetermined quantity of this material.

The device comprises also two members capable of relative displacement and maintained side-by-side by a magnet, the device being subjected to a force opposite the magnetic attraction exerted by the magnet of a value that depends on the weight of material contained in the dispensing receptacle, this opposite force freeing this member from the other when it is equal to the said attractive force.

Use particularly for electric coffee mills.

Also could be cited the following patents: EP-A-0 221 419; U.S. Pat. No. 4,568,006; EP-A-0 024 310; U.S. Pat. No. 4,765,499. These patents describe protective snap-on capsules with or without a valve, but no connecting dispensing closure.

The invention relates to a container for coffee beans which can be applied directly to a coffee mill, the connecting closure comprising a dispenser.

The technical advantages are numerous.

There is no handling.

The package secures directly to the coffee mill.

There is complete conservation of the product.

Stock control can be meticulous.

There is obtained an aesthetic appearance of the coffee apparatus (container-coffee mill) which can sit on a counter.

To this end, the package, particularly for coffee beans, is of the can type with an extensible flexible plastic neck secured by a ring inserted in the opening of the can which forms a cone at this level. It comprises a snap-on protective cap which snaps onto the metal part of the securement ring and which protects the neck which is itself closed by a screw cap. Between the neck and the screw cap is disposed a ring traversed by a valve which serves as a gas release valve. The thread size of the withdrawable neck is characterized by the fact that it can receive means serving as a dispensing connecting closure.

The dispensing connecting closure comprises, at a first end, an adapter cone, followed by a screw-threaded cylindrical portion which permits securement to the threaded end of the neck. The adapter cone of the connecting closure is sufficiently large that the package will be stable when secured to said closure. The screw-threaded portion of the connecting closure is followed by means serving as a dispenser, such as a distributing drawer provided with a drawer pull. The second end of the connecting closure can be coupled with the inlet opening of the ground coffee of the coffee mill.

The accompanying drawings are given by way of indicative example and are not limiting. They show a preferred embodiment according to the invention. They permit easy comprehension of the invention.

Figure 1:
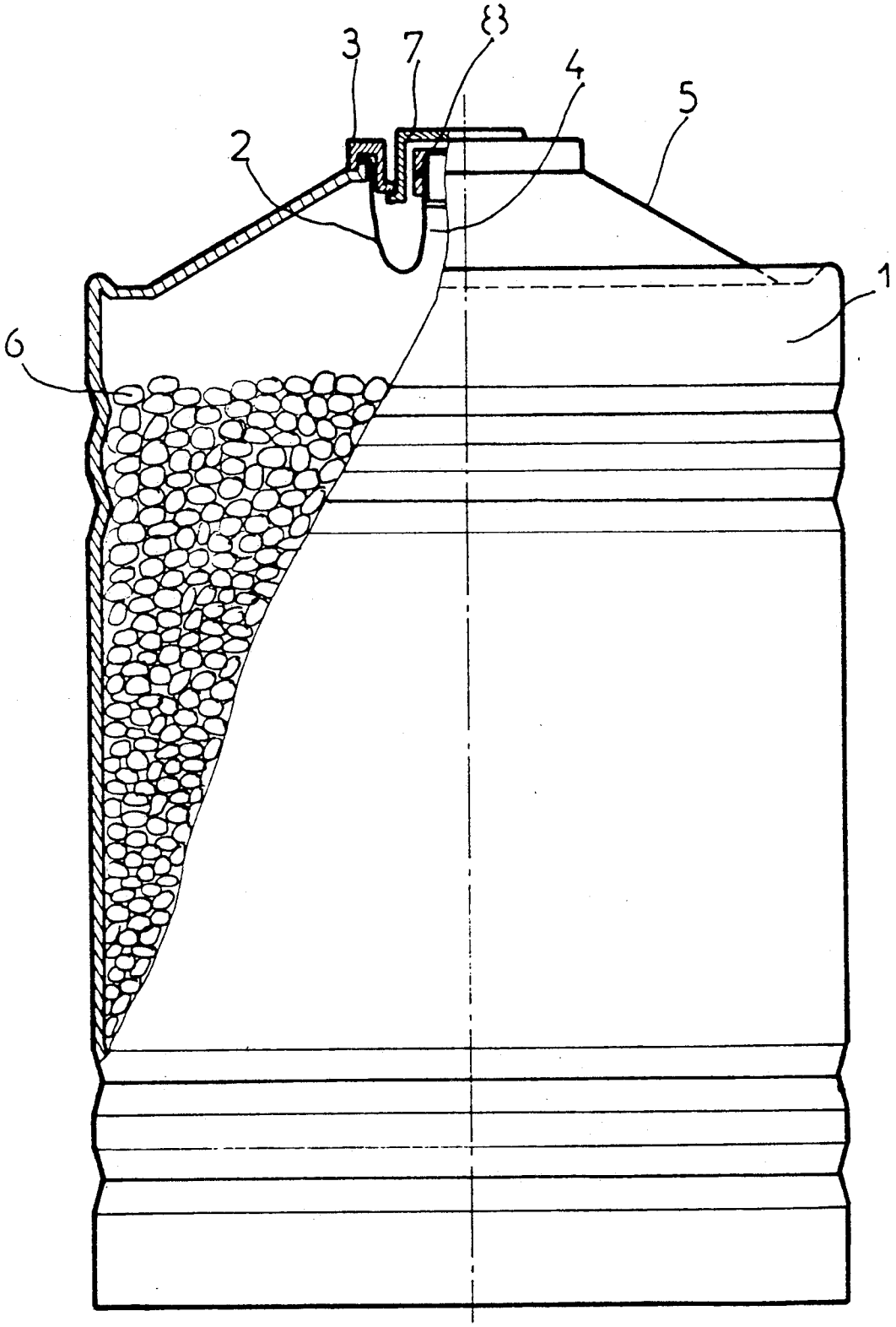
FIG. 1 is a view of the packaging of the metal can type, partially sectioned at the level of the closure.
Figure 2:
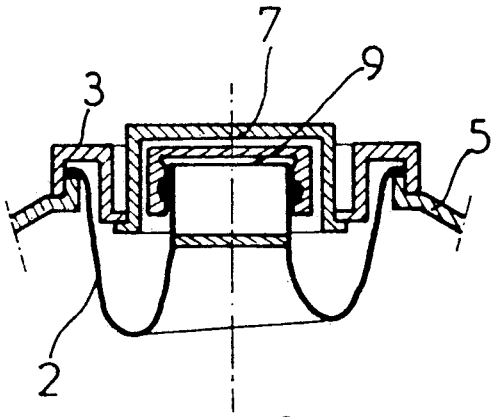
FIG. 2 is a cross-sectional view at the level of the closure, the assembly being in closed position and the neck being in retracted position.
Figure 3:
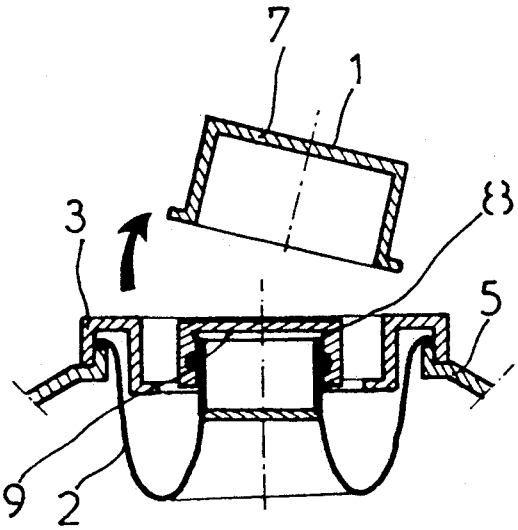
FIG. 3 shows the removal of the protective snap-on cap.
Figure 4:
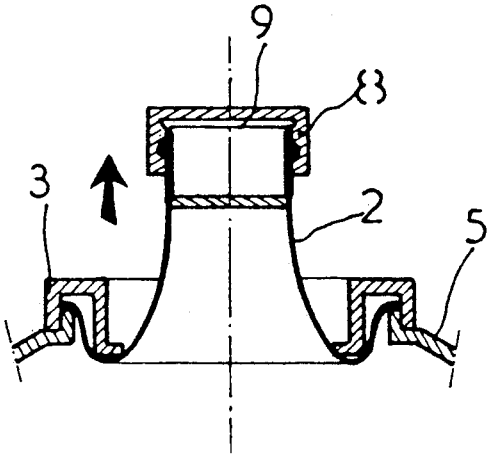
FIG. 4 shows the withdrawal of the neck.
Figure 5:
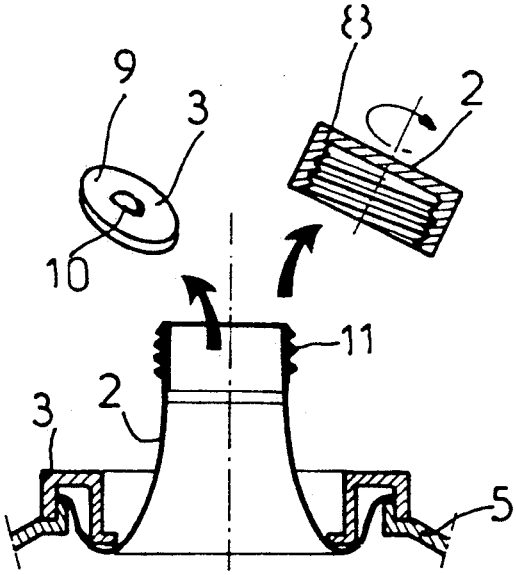
FIG. 5 shows the withdrawal of the threaded cap of the neck and the ring with its gas release valve.
Figure 6:
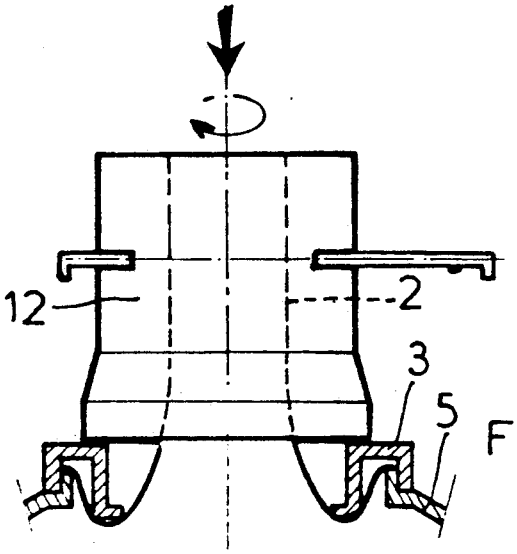
FIG. 6 shows the positioning of the dispensing connecting closure by screwing onto the neck.
Figure 7:
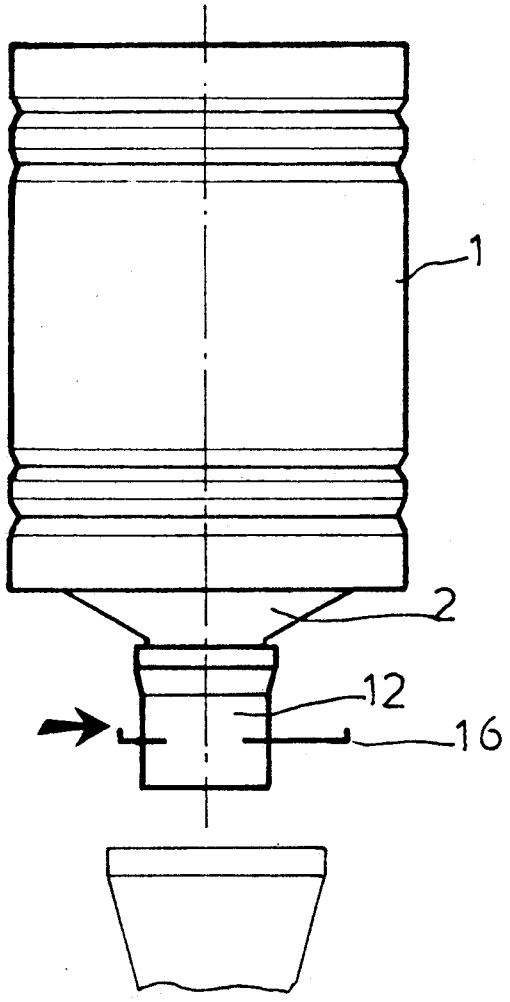
FIGS. 7 and 8 show the action of the drawer pull of the distributing drawer, when the metallic can is inverted and disposed on a receptacle or directly on the coffee mill.
Figure 8:
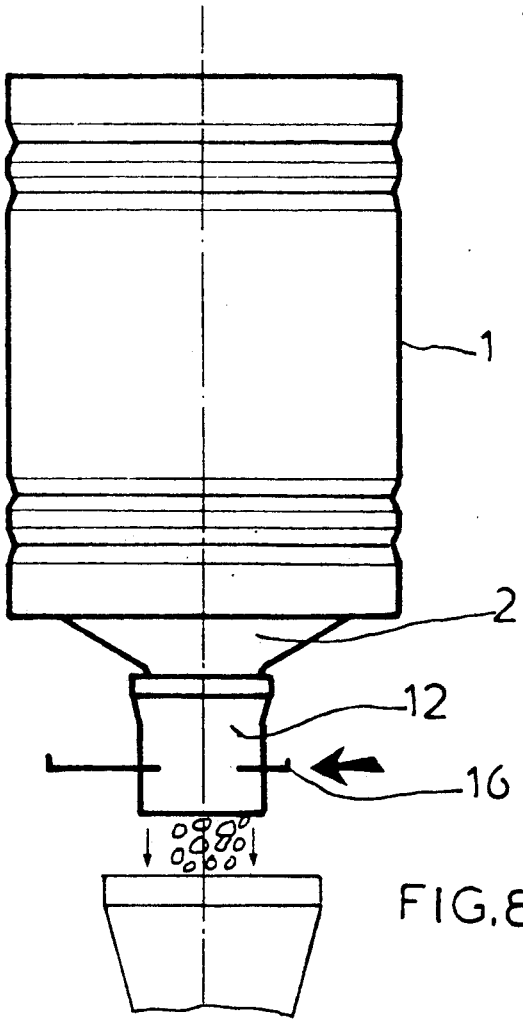
Figure 9:
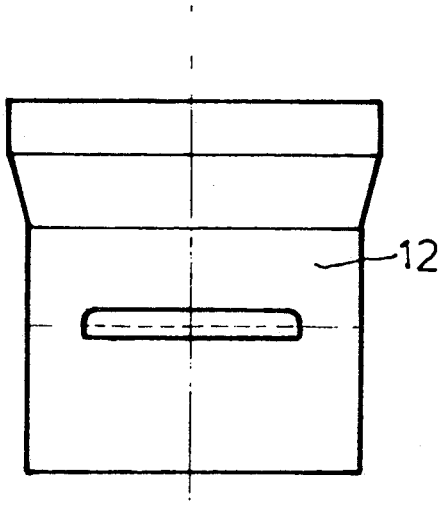
FIGS. 9, 10 and 11 are respectively elevational, cross-sectional and top plan views of the dispensing connecting closure.

The packaging is of the type comprising a metal can 1, with a withdrawable flexible plastic neck 2 secured by a ring 3 clamped over the opening 4 of can 1. The can comprises at this level a cone 5 which facilitates the flow of coffee beans 6 through opening 4 when the can 1 is inverted on its cone 5.

The can 1 comprises a snap-on protective cap 7 which snaps into the metallic part of ring 3 clamped on the margins of opening 4 of can 1. This protective cap 7 protects the neck 2 which is itself provided with a screw cap 8.

Between the screw cap 8 and the neck 2 is interposed an apertured ring 9 which receives a valve 10 which serves as a gas-release valve (for example in the case of the generation of $CO_2$).

The end 11 of withdrawable neck 2 is screw threaded and can receive a dispensing connecting closure 12.

The dispensing connecting closure 12 comprises, at a first end, an adapter cone 13 followed by a screw-threaded cylindrical portion 14 which permits securement to the screw-threaded end 11 of neck 2. The adapter cone 13 of the connecting closure 12 is sufficiently large that the can 1 will be stable when secured by its cone 5 on said connector closure 12.

Figure 10:
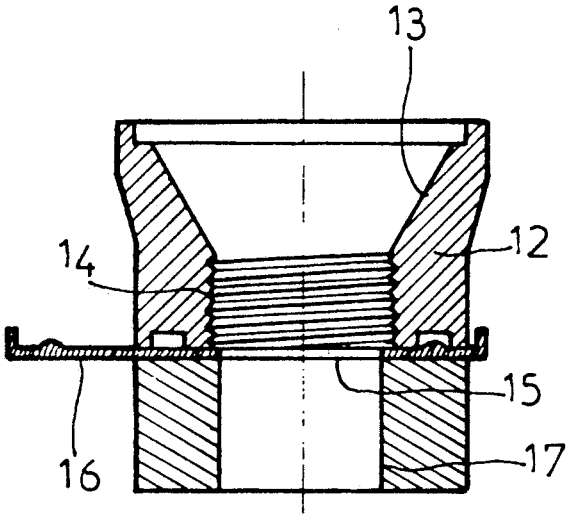
Figure 11:
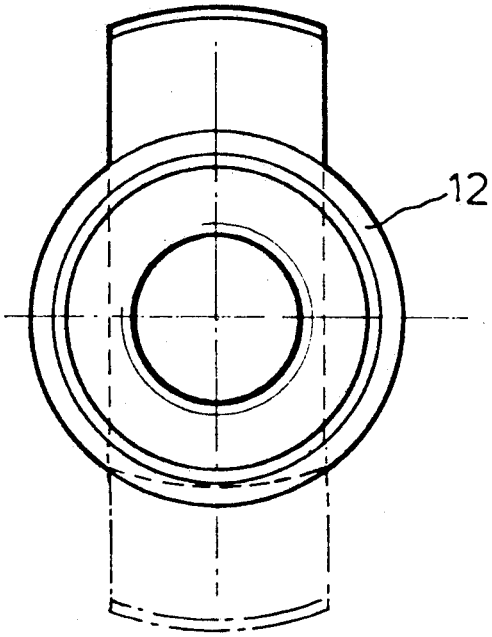

The screw-threaded portion 14 of the connector closure 12 is followed by means serving as a dispenser such as a distribution drawer 15 provided with a drawer pull 16. As is evident from FIG. 10, the drawer pull 16 has two protrusions 18 and 19 thereon adjacent opposite ends of the drawer. The connecting closure 12 has two recesses 20 and 21 therein for reception of the protrusions 18 and 19 respectively. Recesses 20 and 21 are disposed on opposite sides of screw-threaded portion 14 and are located a smaller distance apart than protrusions 18 and 19. As a result, the drawer pull 16 has two spaced respectively open and closed positions in which it will be releasably retained by engagement of protrusion 18 in recess 20, and by engagement of protrusion 19 in recess 21, respectively.

The second end 17 of the connector closure 12 will be connected with the inlet opening of the coffee mill (not shown).

What is claimed is:

1. In a package for coffee beans, comprising a metal can (1) with a withdrawable neck (2) of flexible plastic secured by a ring (3) clamped on an opening (4) of the can (1) which comprises a cone (5) at this level, a protective snap-on cap (7) that snaps onto a metal part of the clamping ring (3) which protects the withdrawable neck (2), itself closed by a screw cap (8); between the neck (2) and the threaded cap (8) there being an apertured ring (9) which serves as a gas release valve; the improvement wherein the end of the withdrawable neck (2) has a screw-threaded end (11) and receives means serving as a dispensing connecting closure (12); the dispensing connecting closure (12) comprises, at its first end, an adapter cone (13) followed by a screw-threaded cylindrical portion (14) which permits securement to said screw-threaded end (11) of the neck (2); the adapter cone (13) of the connecting closure (12) being sufficiently large that the can (1) will be stable when supported upside down by its cone (5) on said connecting closure (12), the screw-threaded portion (14) of the connecting closure (12) being followed by means serving as a dispenser in the form of a distributor drawer (15) provided with a drawer pull (16), the drawer pull (16) being followed by a second end (17) of the connecting closure (12) which is cylindrical for connection with an inlet opening of a coffee mill, said distributor drawer (15) having two protrusions thereon adjacent opposite ends of the drawer, said connecting closure (12) having two recesses therein for reception of said projections, said recesses being disposed on opposite sides of said screw-threaded portion (14), said recesses being located a smaller distance apart than said protrusions, so that said drawer pull has two spaced respectively open and closed positions in which said drawer pull will be releasably retained by engagement of a said projection in a said recess.

* * * * *